US005500953A

United States Patent [19]

Reuber et al.

[11] Patent Number: 5,500,953

[45] **Date of Patent: *Mar. 26, 1996**

[54] DOUBLE LENS ELECTRIC SHIELD

[75] Inventors: Douglas A. Reuber, Lindsay; Amsey Buehler, Cobourg, both of Canada

[73] Assignee: 546401 Ontario Limited, Lindsay, Canada

[ * ] Notice: The term of this patent shall not extend beyond the expiration date of Pat. No. 5,351,339.

[21] Appl. No.: 198,137

[22] Filed: Feb. 17, 1994

Related U.S. Application Data

[63] Continuation-in-part of Ser. No. 25,873, Mar. 3, 1993, Pat. No. 5,351,339.

[30] Foreign Application Priority Data

Feb. 3, 1993 [CA] Canada ..... 2090805

[51] Int. Cl.[6] ..... A42B 3/24

[52] U.S. Cl. ..... 2/9; 2/15; 2/424; 2/425; 219/211

[58] Field of Search ..... 2/7, 8, 9, 10, 15, 2/410, 422, 424, 425, 435, 6.3, 6.4, 6.5, 418, 417; 219/203, 211, 543, 147

[56] References Cited

U.S. PATENT DOCUMENTS

| | | | |
|---|---|---|---|
| 2,739,310 | 3/1956 | Frieder et al. | 2/418 |
| 2,747,191 | 5/1956 | Hoffmaster | 2/8 |
| 3,024,341 | 3/1962 | Ogle, Jr. et al. | 219/20 |
| 3,090,046 | 5/1963 | Bowers, Sr. | 2/8 |
| 3,137,005 | 6/1964 | Herbine et al. | 2/8 |
| 3,517,392 | 6/1970 | Hodge et al. | 2/8 |
| 3,787,894 | 1/1974 | Goodman, Jr. | 2/418 |
| 3,797,041 | 3/1974 | Raschke | 2/8 |
| 4,462,119 | 7/1984 | Rudd | 2/424 |
| 4,584,721 | 4/1986 | Yamamoto | 2/424 |
| 4,638,728 | 1/1987 | Elenewski | 2/435 |
| 4,668,270 | 5/1987 | Ramus | 219/203 |
| 4,682,007 | 7/1987 | Hollander | 219/211 |
| 4,868,929 | 9/1989 | Curcio | 2/435 |

FOREIGN PATENT DOCUMENTS

| | | | |
|---|---|---|---|
| 1201149 | 2/1986 | Canada . | |
| 1285976 | 7/1991 | Canada | 2/435 |
| 2091527 | 7/1982 | United Kingdom . | |

*Primary Examiner*—Michael A. Neas

*Attorney, Agent, or Firm*—Alistair G. Simpson; Ronald D. Faggetter; G. Kendall Parmelee

[57] ABSTRACT

Known protective helmets used for motorcycle riding, flying and snowmobiling employ transparent visors that have heating elements to reduce and attempt to eliminate the build-up of ice, condensation and fog. A double-lensed face shield is provided with a pair of electrodes formed on an inner face lens, in the air pocket formed between the inner face lens and the outer weather lens. Substantially across one entire surface of the inner face lens is formed an electroconductive film. An upper electrode extends from a first end along an upper margin of the inner face lens on the film to a second end. On the opposite lower margin extends on the film a lower electrode from a first end to a second end. An insulated contact passes from one side of the inner lens to the other and connects the first end of the lower electrode with a conductor which extends on the opposite side of the inner lens towards the first end of the upper electrode. Power supplied across the first end of the upper electrode and the tail end of the conductor will result in electrical flow across the film inhibiting fog, ice and frost. Also provided is an assembly to permit the installation of face shields on helmets of different sizes and with openings of different configurations.

20 Claims, 10 Drawing Sheets

DOUBLE LENS ELECTRIC SHIELD

The present invention relates generally to shield structures in particular to shield structures for protective helmets.

This application is a continuation-in-part of U.S. application Ser. No. 08/025,873, filed Mar. 3, 1993, now U.S. Pat. No. 5,351,339.

PRIOR ART

Shield structures for protective helmets are well known. For example, protective helmets used for snowmobiling and motorcycle riding typically have transparent shields or visors. One of the problems with such shield structures is that in certain climatic conditions, such as in rain, or cold weather, the transparent shield will fog or become iced. U.S. Pat. No. 3,024,341 which issued to Ogle et al. on Mar. 6, 1962 discloses a pilot's helmet with a transparent visor on the surface of which is deposited a transparent electrically conducting film. Ogle also discloses sandwiching an electroconductive film between two transparent laminated sheets to form a visor. The result is a visor which may be electrically heated to reduce the build-up of fog, condensation or ice.

Various other variations are known in the heating of a transparent visor or shield on a protective helmet. For example, the applicant's own Canadian Patent No. 1,285,976 which issued on Jul. 9, 1991 discloses a double lens electric shield having a surface of one of the lenses printed with an electrically conductive circuit which is arranged in a pattern of continuous generally parallel lines or ribbons.

U.S. Pat. No. 4,584,721 which issued to Yamamoto on Apr. 29, 1986 discloses a transparent shield having a heat generating electroconductive film formed on the inner surface of the shield panel. In Yamamoto, the electroconductive film is deposited upon a heat generating plate which is secured to a support plate. The support plate is releasably attachable to the shield panel. Formed in parallel on the electroconductive film are a pair of electrodes. Yamamoto discloses several other arrangements of electrodes and electrical connections. When an electrical potential is applied between the pair of electrodes an electrical current will flow from one electrode across the electroconductive film to the other electrode, generating heat across the electroconductive film. The arrangement of the electrodes in Yamamoto attempt to provide a uniform or almost uniform heating of the electroconductive film.

In such a visor as disclosed in Yamamoto it is desirable to have the electric power leads for the upper and lower electrodes connected at the same side of the shield. Yamamoto discloses one such arrangement, in particular the use of one electrode having an extension portion also formed on the electroconductive film and a cut line in the film between the electrode and its extension.

There are however some drawbacks to this arrangement which the present invention seeks to overcome. It is possible that there could be an electrical short between the electrode and its extension across the cut line, at a point other than the connection point. The result would be that there would not be uniform heating of the electroconductive film.

Yamamoto discloses alternative electrode arrangements for the heat generating plate of the face shield to which lead wires may be connected to provide uniform heating of the electroconductive film. The use of such electrode arrangement with the Yamamoto design is problematic, however, as the lead wires are easily damaged or disconnected from the electrodes thereby rendering the heating feature inoperative. Further, the electrode and lead wire configuration is relatively expensive to manufacture, requiring further components and assembly operations.

Another problem associated with shields and visors is that the visor can become damaged, scratched, etc. In such circumstances it is not desirable to have to replace the entire protective helmet. To solve this problem it is already known to provide detachable visors for helmets.

Yamamoto discloses a helmet to which a shield panel is removably attached by mount screws. However for a given helmet, if it is desired to replace the shield panel, it is necessary to use a shield panel that is specifically adapted and sized to attach with the mount screws. Thus, it may be necessary to have different shield panels for each of several slightly different sized helmets. The present invention also seeks overcome the disadvantages inherent with such shield panels by providing an adaptable shield panel which can be utilized with a wide range of helmet shapes and sizes.

Helmet shield panels which extend over the full facial area of a wearer present problems additional to those addressed in the prior art. Setting up a constant electrical current over the full surface of the shield panel poses difficulties given the large surface area of the panel. Further, the areas of the shield panel adjacent the wearer's mouth and nose will be directly impacted by a greater amount of condensation from breath vapour and thus this area will require greater heating than the areas nearer the wearer's eyes and forehead. The shield panel of the face shield of the present invention seeks to overcome the disadvantages inherent in this special category of shield panel by providing means for obtaining differential heating of the shield panel.

SUMMARY OF THE INVENTION

According to one aspect of the invention, there is provided a face shield for a helmet comprising the following, a weather lens; a face lens spaced from said weather lens by spacer means so as to form an appreciable air gap between said weather lens and said face lens, said face lens having a surface facing said air gap; a first electrode extending along a margin of said face lens on said air gap facing surface and a second electrode extending along a margin of said face lens opposite said first electrode on said air gap facing surface; a first contact in electrical contact with said first electrode, said first contact extending from an end of said first electrode through said face lens to a first conductor; a second contact in electrical contact with said second electrode, said second contact extending from an end of said second electrode relatively farthest from said first contact, said second contact extending through said face lens to a second conductor; means for electrically connecting said first and second conductors to a source of electrical power; a transparent conductive film extending between said first electrode and said second electrode on said air gap facing surface, said film having sufficient electrical resistance to create heat effective to inhibit formation of fog, ice or frost upon said face shield when said terminal connector is connected to a source of electrical power.

According to another aspect of the present invention, there is provided for a helmet face shield, a face lens comprising: a first layer having an inner surface and an outer surface; a first electrode extending along a first margin of said outer surface of said first layer and a second electrode extending along a second margin of said outer surface of said first layer opposite said first electrode; a first contact electrically connected to said first electrode and extending from said outer surface through said first layer to said inner surface of said first layer to a first conductor, said first conductor extending from an end along a first margin of said inner surface of said first layer and generally along said first electrode, toward an end of said first electrode; a second contact electrically connected to said second electrode and extending from said outer surface through said first layer to said inner surface of said first layer to a second conductor, said second conductor extending from an end along a second margin of said inner surface of said first layer opposite said first conductor and generally along said second electrode toward an end of said second electrode; a transparent electrical conductive film extending between said first and second electrodes on said outer surface of said first layer; means for connecting a terminal connector to said first conductor at a first connection point and to said second conductor at a second connection point, said first and second connection points located proximate one another, said terminal connector for connection to a source of electrical power; and said film having sufficient electrical resistance to create heat effective to inhibit formation of fog, ice or frost over said first layer between said electrodes when a terminal connector is connected to said first and second conductors and to a source of electricity.

According to yet another aspect of the present invention, there is provided for a helmet face shield, a face lens comprising: a first layer having an inner surface and an outer surface; a first electrode extending along a first margin of said outer surface of said first layer, a second electrode extending along a second margin of said outer surface of said first layer opposite said first electrode and a third electrode extending along said outer surface of said first layer between said first and second electrodes; a first contact electrically connected to said first electrode and extending from said outer surface through said first layer to said inner surface of said first layer to a first conductor, said first conductor extending from an end along a first margin of said inner surface of said first layer and generally along said first electrode, toward an end of said first electrode; a second contact electrically connected to second electrode and extending from said outer surface to said first layer to said inner surface of said first layer to a second conductor, said second conductor extending from an end along a second margin of said inner surface of said first layer opposite said first conductor and generally along said second electrode toward an end of said second electrode and electrically connected with said first conductor; a third contact electrically connected to said third electrode and extending from said outer surface through said first layer to said inner surface of said first layer to a third conductor, said third conductor extending from an end along said inner surface of said first layer between said first and second conductors and generally along said third electrode toward an end of said third electrode; a transparent electrical conductive film extending between said first and third electrodes and between said third and second electrodes on said outer surface of said first layer; means for connecting a terminal connector to said first conductor in electrical contact with said second conductor at a first connection point and to said third conductor at a second connection point, said first and second connection points located proximate one another, said terminal connector for connection to a source of electrical power; and said film on said face lens having sufficient electrical resistance to create heat effective to inhibit formation of fog, ice or frost over said first layer between said first and third and said second and third electrodes when a terminal connector is connected to said first, second and third conductors and to a source of electricity.

According to another aspect of the present invention, there is provided a face shield for a full face helmet with a helmet opening, said face shield comprising: a lens; a frame having a frame opening, said frame opening adapted for sealed engagement with said helmet about the periphery of said helmet opening; a housing extending about the periphery of said lens to support said lens, Joined at said frame at opposed pivots and movable between a first position whereat said lens covers said opening and second position whereat said lens is pivoted away so that said lens does not cover said opening; a helmet attachment means comprising a flexible band attached to said frame at opposed attachment points and adjustment means to adjust the length of said flexible band between said attachment points.

DESCRIPTION OF THE PREFERRED EMBODIMENTS

Figure 1A:
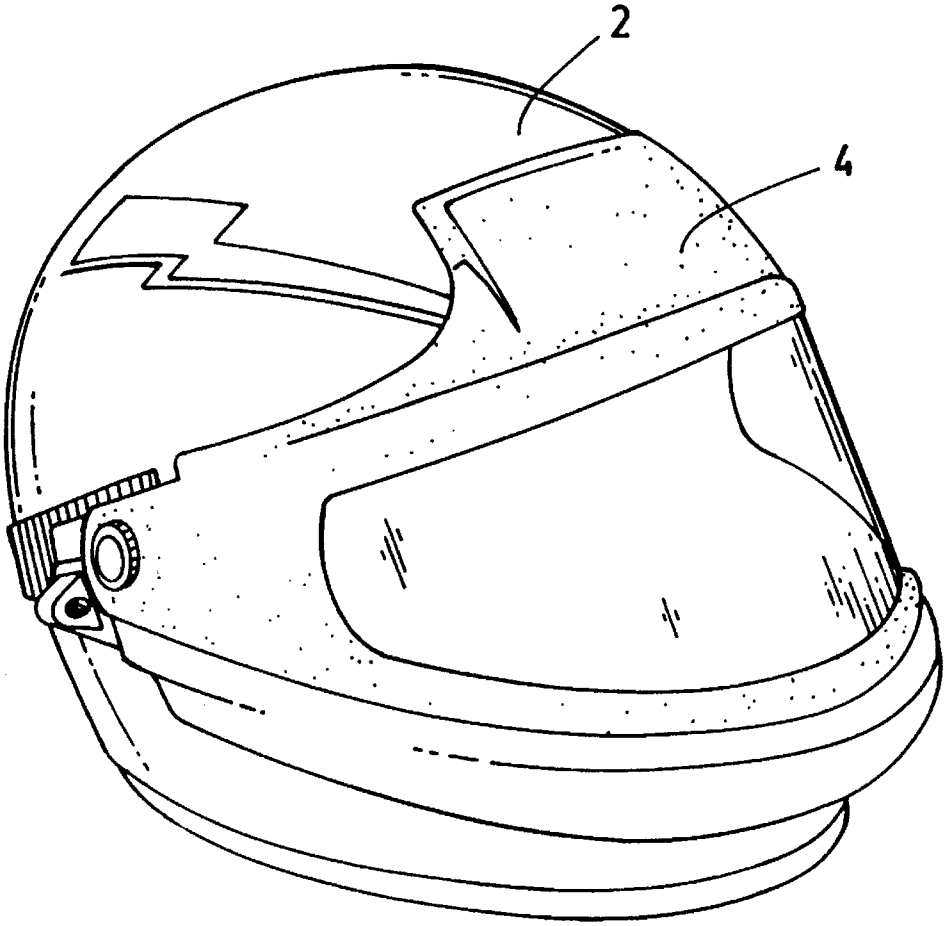
FIG. 1A is a perspective view of a protective helmet employing a face shield made in accordance with an embodiment of this invent ion.
Figure 1B:
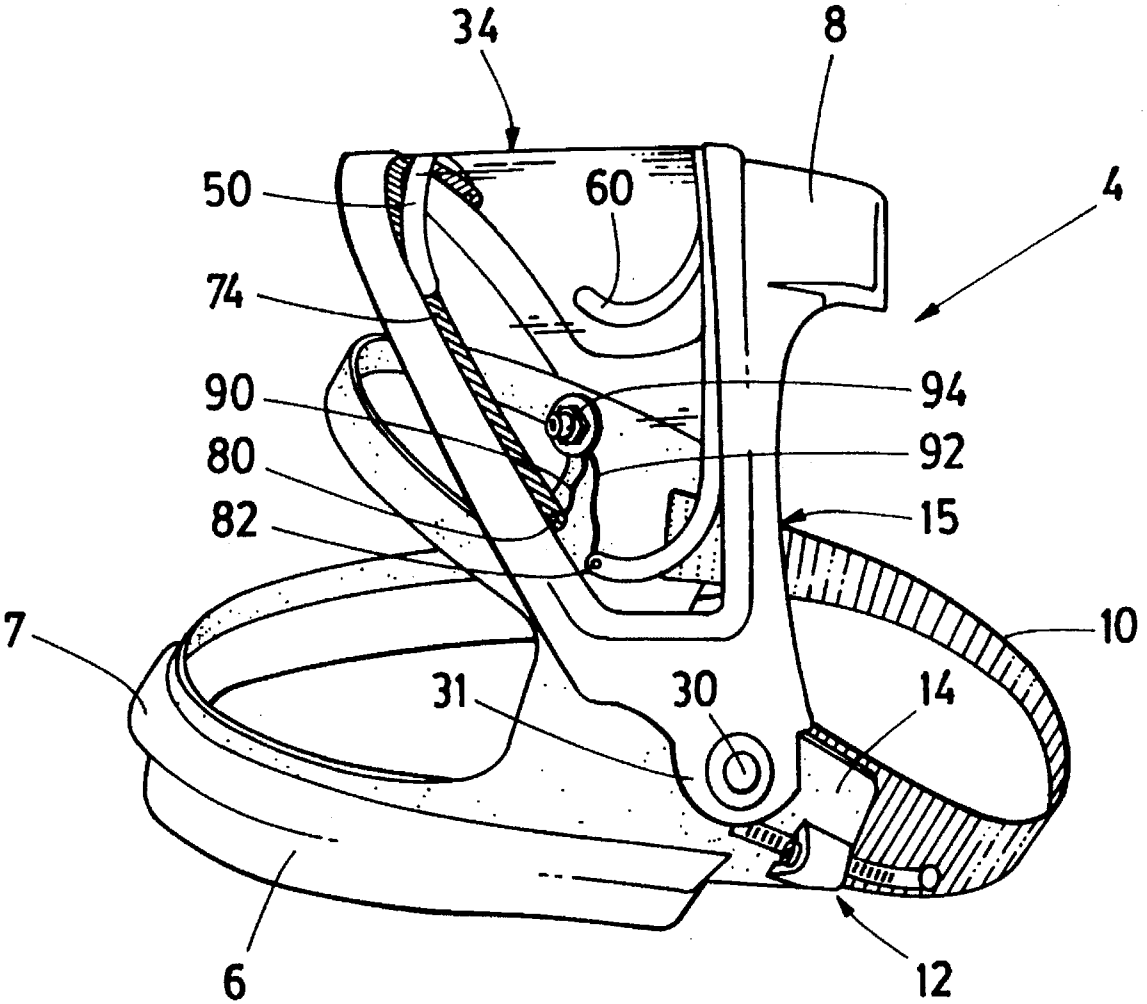
FIG. 1B is a perspective view of a face shield for a helmet made in accordance an embodiment of the invention.

FIG. 1A shows a helmet 2 having a face shield generally depicted as 4. As shown in FIG. 1B face shield 4 comprises a housing 8 secured to a frame 6 having a lip 7. Housing 8 and frame 6 are preferably made from ABS and consequently have some flexibility. Polycarbonate is another possible choice of material. Both frame 6 and housing 8 are generally curved and shaped to fit over and around the opening of helmet 2 as shown in FIG. 1A.

Figure 2:
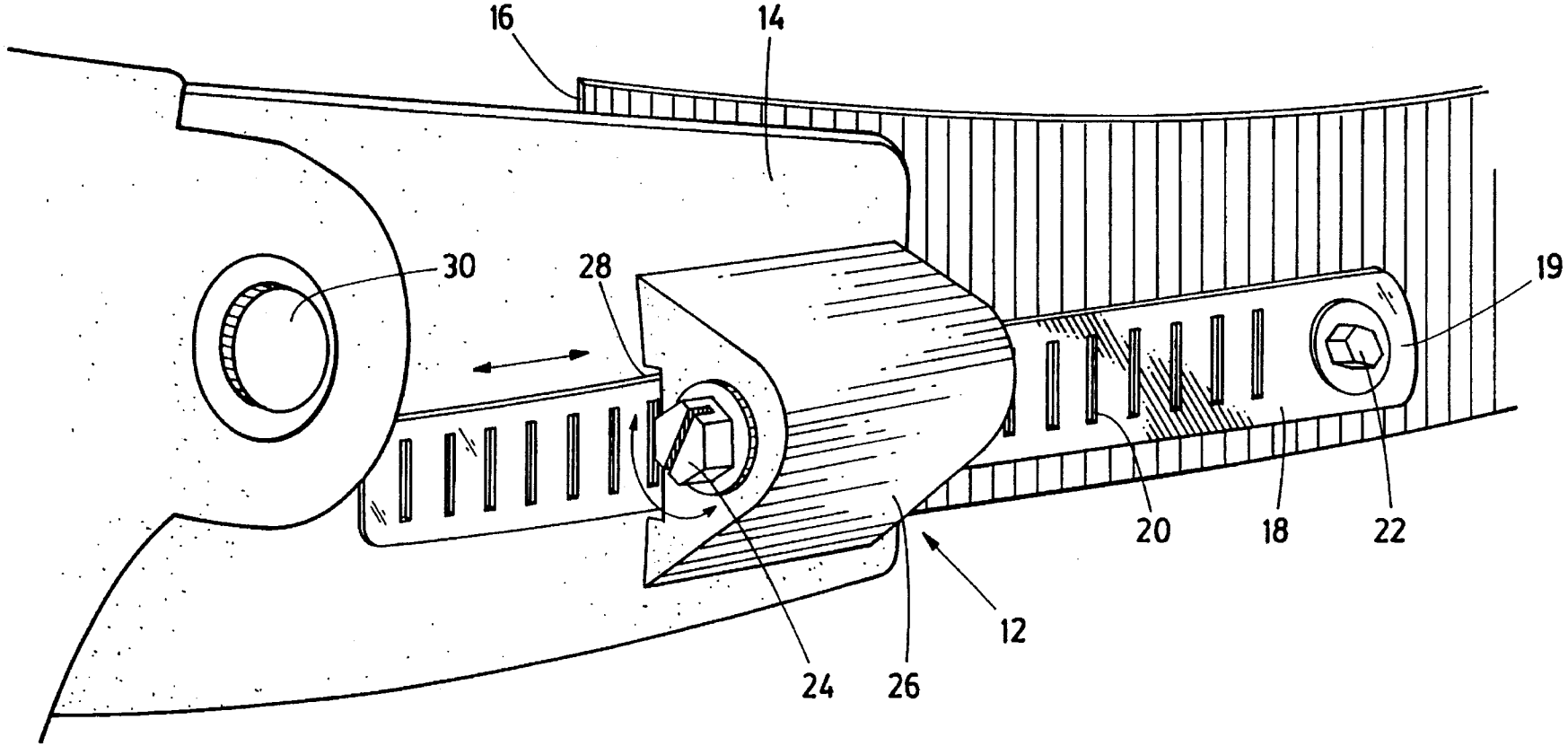
FIG. 2 is an enlarged perspective view of part of the face shield shown in FIG. 1B.

Attached to frame 6 is a flexible band 10 secured by adjustable attachment means generally designated 12. Frame 6 may only have a single attachment means 12 located at the rear side portion 14 of frame 6. Alternatively in a preferred embodiment, frame 6 may have a second attachment means (not shown) located at the opposite rear side portion 15 of frame 6. As depicted in FIG. 2, the attachment means 12 comprises a track 18, a screw housing 26, and a screw 24. A first end 19 of track 18 is secured well behind leading edge 16 of flexible band 10. Track 18 is typically made from a durable plastic or metal and has a series of parallel-spaced longitudinal openings 20. The track 18 is secured at first end 19 to flexible band 10 by a conventional bolt and nut combination generally designated 22. Flexible band 10 can pivot relative to track 18 at bolt-nut combination 22. Screw 24 is received and held in a position generally parallel to track 18 in screw housing 26 but is free to rotate therein. Screw housing 26 which is attached to, or may be integrally formed with the rear side portion 14 of frame 6 has a slot 28 running longitudinally through it. Screw 24 is positioned so that its threads (not shown) will engage openings 20 of track 18. Rotation of screw 24 in one direction will cause track 16 to be drawn through slot 28 thereby tightening flexible band 10 around helmet 2. Rotation of screw 24 in the opposite direction will push track 18 in the opposite direction. This adjustment device permits the housing 8 and frame 6 to be adapted to fit a variety of helmets of different sizes and shapes.

Returning to FIG. 1B, housing 8 is secured to frame 6 proximate the opposed attachment means 12 by a conventional threaded bolt ( not shown ) which passes through openings ( not shown) in the opposed side portions 31 of housing 14 and are secured by a pair of threaded nuts 30. As housing 8 is somewhat flexible, if nuts 30 are removed, housing 8 can be removed from frame 6.

Housing 8 can pivot relative to frame 6 about the opposed pivots created by bolts and nuts 31. Housing 8 is movable and pivots between a closed position wherein the housing rests on lip 7 of frame 6, as depicted in FIG. 1A, and an open position as shown in FIG. 1B.

The provision of attachment means 12 on frame 6 permits the face shield 4 to be utilized with helmets having different sized openings and being of different sizes, and can be used on helmets with or without electrical heating devices.

Figure 3:
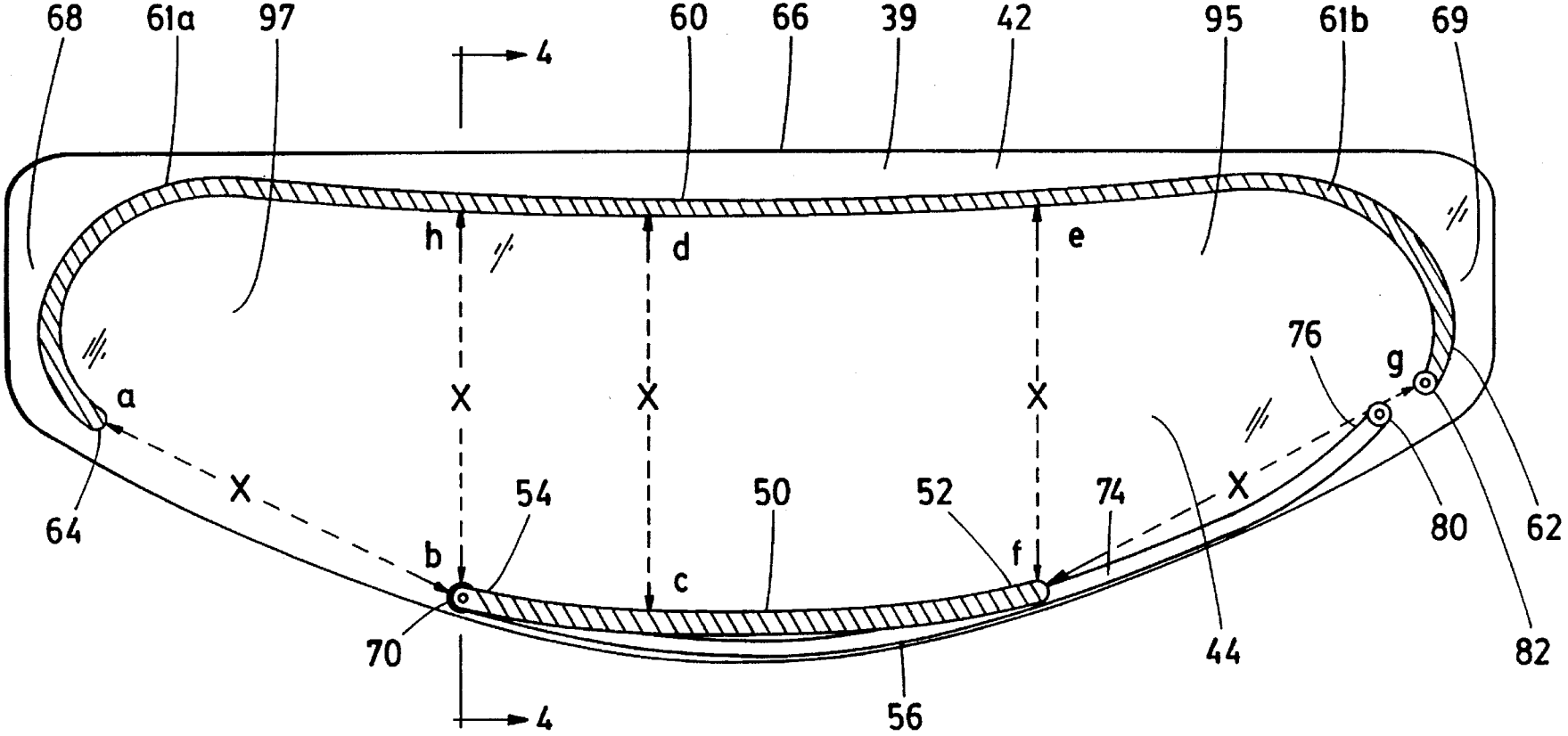
FIG. 3 is a flattened plan view of part of the face lens of FIG. 1.
Figure 4:
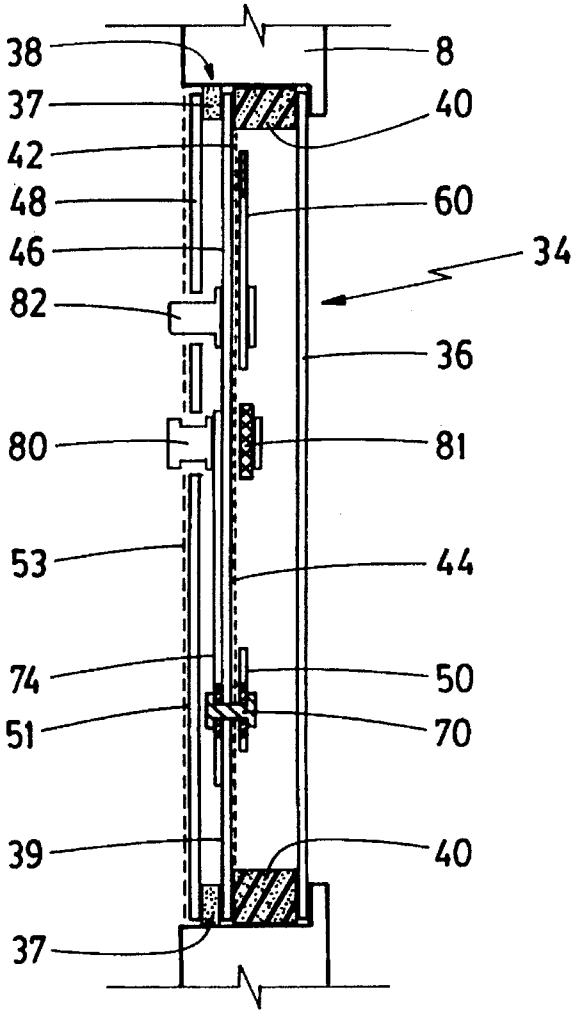
FIG. 4 is a cross-sectional view along the lines 4—4 of the face lens shown in FIG. 3.

Housing 8 has an opening which is filled by a lens assembly 34. Housing 8 supports lens assembly 34 at its periphery. Turning to FIGS. 3 and 4, lens assembly 34 comprises a transparent outer weather lens 36 and a transparent inner face lens 38. In the embodiment shown, the weather lens and the inner face lens are coextensive. Weather lens 36 is spaced from face lens 38 by upper and lower spacers generally designed as 40. Spacers 40 are typically made from a material such as neoprene. The spacing of weather lens 36 and face lens 38 provides an air pocket therebetween, which preferably is sealed.

Face lens 38 comprises a transparent inner layer 39 and a transparent backing layer 48. In the embodiment shown in FIG. 4 inner layer is spaced from backing layer 48 by spacers 37. However, in another preferred embodiment, inner layer 39 is laminated to backing layer 48.

Backing layer 48 has a rear face 51 to which may be applied an anti-fog coating 53 substantially across its entire surface. Anti-fog coating 53 may be either a hydrophillic coating or a hydrophobic coating, and will inhibit the build-up of fog on the rear face 51.

FIG. 3 shows inner layer 39 as it would appear if flattened out. Inner layer 39 has an air gap facing surface 42 to which is applied a transparent electroconductive film 44, which substantially covers the air gap facing surface. A preferred embodiment of the inner layer 39 and the electroconductive film 44 is a composite product comprising a PET substrate (polyester) to which is applied by sputter coating, a thin layer of indium tin oxide (ITO). Such an ITO coating provides high visible light transmission, low reflectivity and uniform electrical conductivity. Backing layer 48 is preferably made from a material such as a polycarbonate, butyrate or an acrylic.

Applied to the air gap facing surface 42 of inner layer 39 on top of electroconductive film 44 is a first lower electrode 50 having a first end 52 and second end 54. The first electrode extends generally along and adjacent a portion of the lower margin 56 of inner layer 38. A second upper electrode 60 has a first end 62 and a second end 64 and extends along the upper margin 66 and along side margins 68 and 69 of inner layer 39. As shown in FIG. 3, the first end 62 of second electrode 60 is more proximate the first end 52 of first electrode 50 than the second end 54 of first electrode 50. The inner layer 39 is shaped to fit the opening in housing 8. As shown in FIG. 3, the edge of the inner layer 39 adjacent the margin 56 along which first electrode 50 extends is convexly radiused. The opposite edge of inner layer 39 adjacent the upper margin 66 along which second electrode 60 extends is substantially straight. First electrode 50 and second electrode 60 are preferably made from an electrically conductive silk screen ink.

A contact 70 passes through inner layer 39 and connects second end 54 of first electrode 50 to an end 72 of a conductor 74. Conductor 74 is also typically made from an electrically conductive silk screen ink and extends along the rear face 46 of inner layer 39, generally along the first electrode 50, past the end 52 towards the first margin 69 and towards end 62 of second electrode 60 terminating in end 76. If inner layer 39 is laminated to backing layer 48, conductor 74 is sandwiched therebetween. This backing layer 48 will protect conductor 74.

Conductor 74 has a terminal connector 80 connected to its end 76. Terminal 80 is electrically insulated by an insulator 81 from the electroconductive film on air gap facing surface 42. At end 62 of second electrode 60, a second connector 82, which passes through both backing layer 48 and inner layer 39, is connected to the second electrode 60. An electric potential may be applied across terminals 80 and 82 which results in an electrical potential between first electrode 50 and second electrode 60 so that an electrical current will flow across electroconductive film 44 between the first electrode and the second electrode. Clearly the electrodes have some resistivity. Consequently, there is a small potential drop across their length.

Where electrical contact is made between electrode 50 and contact 70 and between contact 70 and conductor 74, it has been found that it is preferable that contact 70 is of a design or incorporate means for providing as much area of contact with either electrode 50 or conductor 74 as possible. If such area of contact is insufficient, areas of high localized current flow may be established, resulting in overheating which may result in a burning and, therefore, failure of the electrical connection. The electrical contact between contact 70 and electrode 50 or conductor 74 may be enhanced by using metal washers where contact 70 comprises a rivet.

Similarly, areas of electrical contact between terminal 80 and conductor 74 and between terminal 82 and electrode 60 would be provided with such means.

As shown in FIG. 1B (not shown in the other Figures) connected to terminal connectors 80, 82 are a pair of power leads 90, 92 which leads to a co-axial connector 94. Co-axial connector 94 is suitable for connection to an electrical power source. The power supplied to terminal connectors 80 and 82 may be direct current or alternating current.

Returning again to FIG. 3, point b is the point of maximum electrical potential of electrode 50 and is positioned toward side 68 side of the inner layer 39 from point g which is positioned toward the side 69 and is the point of maximum opposite electrical potential on electrode 60. Although there will be some loss of potential along the length of both electrodes because they are not perfect conductors, most of the potential drop will occur across the electroconductive film 44. Sufficient heat may be generated to inhibit formation of fog, ice or frost upon the face shield. The upper and lower electrodes are formed on the electroconductive film so that for any given point on an electrode, the shortest distance to the other electrode is approximately the same. For example, the upper electrode 60 is shaped with a curved portion 61*a*. This results in the distance x between point a on electrode 60 and point b on electrode 50 being approximately the same as the distance x between point d on electrode 60 and point c on electrode 50. Thus the potential drop from any point along the length of electrode 50 to the closest point on electrode 60 will be the for the most part, substantially the same. This results in a fairly uniform flow of electrical current across electroconductive film 44, particularly in the rectangular section of the electroconductive film 44 defined by points h, e, f and b and results in fairly uniform heating in this region. This rectangular region is the most critical portion of inner layer 39 requiring heating as this is where most visibility is required for the face shield. However, there will be some electrical flow between electrode 50 across the film to curved portions 61*a* and 61*b*, thus producing heating of the side portions 95, 97 outside of rectangular section d,e,f,b.

Figure 5:
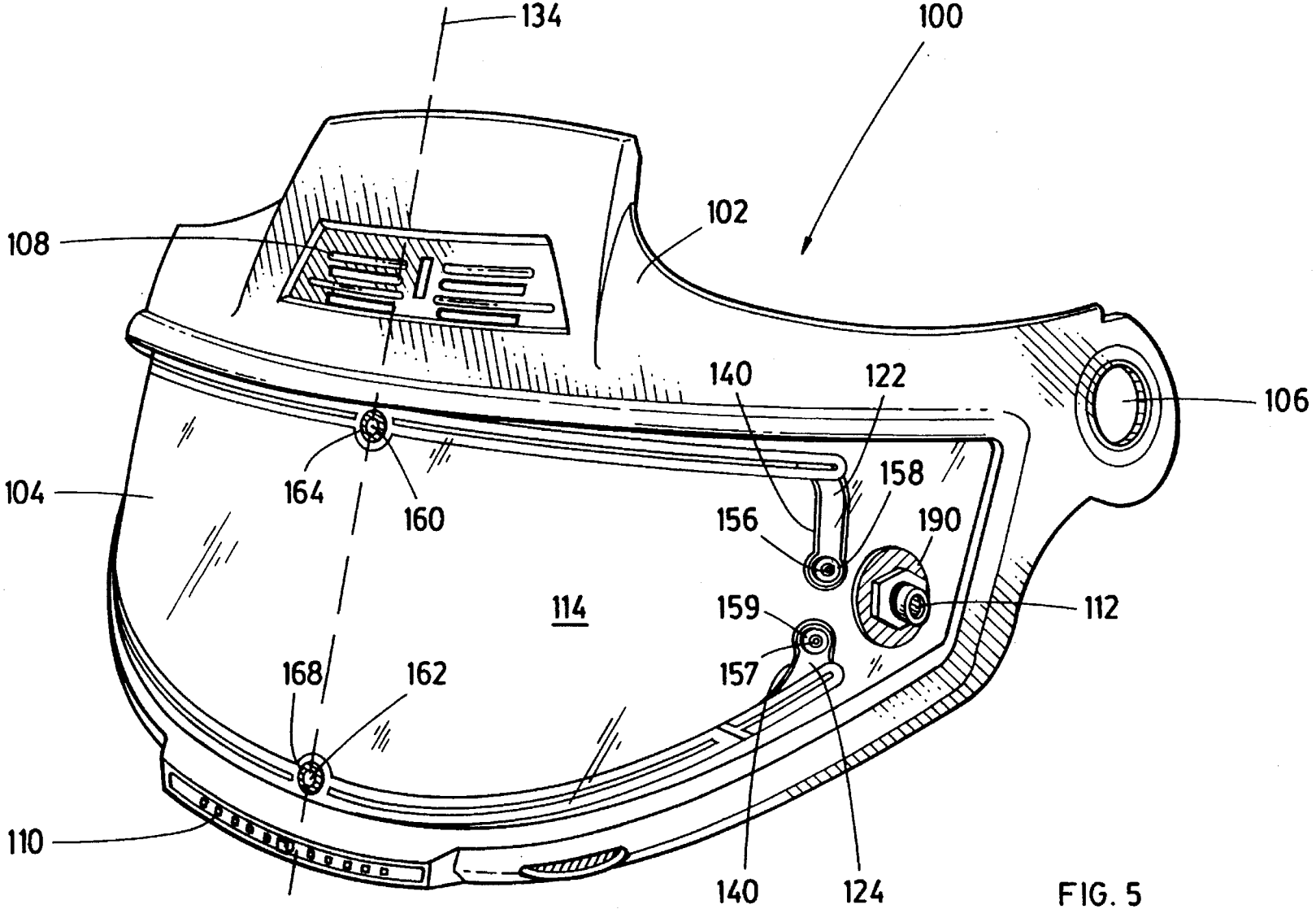
FIG. 5 is a perspective view of a face shield including a face lens made in accordance with another embodiment of this invention.
Figure 6:
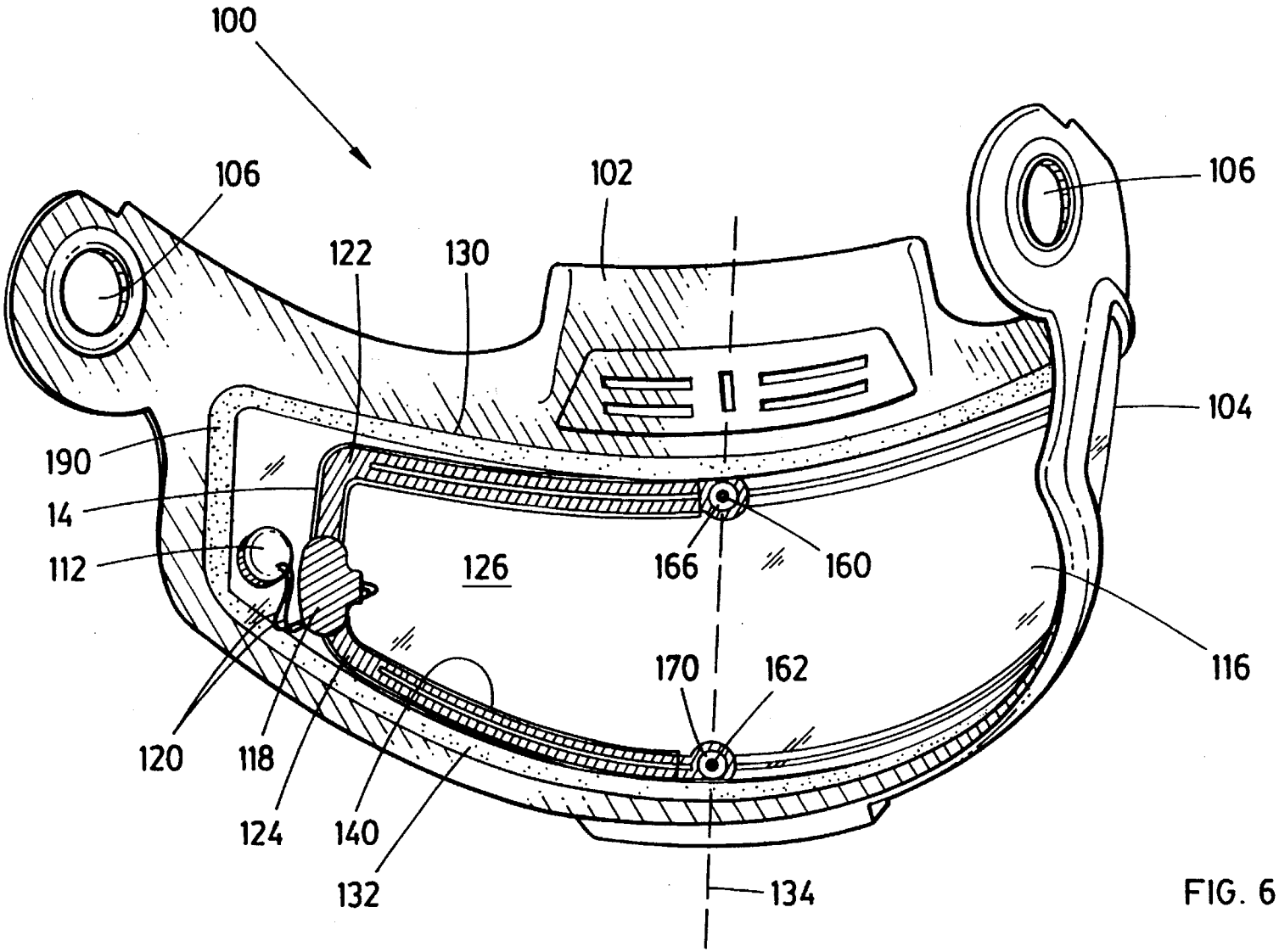
FIG. 6 is a perspective view of the inner surface of the face shield shown in FIG. 5.

FIGS. 5 and 6 show another face shield 100. Housing 102 of face shield 100 would be pivotally secured to the frame adapted to be fitted to a helmet (not shown) in a manner similar to that described above with reference to the embodiment of FIGS. 1 to 4. Housing 102 surrounds and supports lens assembly 104 about its periphery, as described below in greater detail with reference to FIGS. 7 and 8. Housing 102 of face shield 100 is generally curved, appropriately shaped and flexible, to permit it to fit over and around the openings in a variety of helmets. One such helmet is depicted in FIG. 1A. As a result of such design, face shield 100 may be purchased separately as a replacement for an existing face shield.

Air vents 108 and 110 are included in housing 102 to provide ventilation within the helmet to which face shield 100 is attached.

Figure 8:
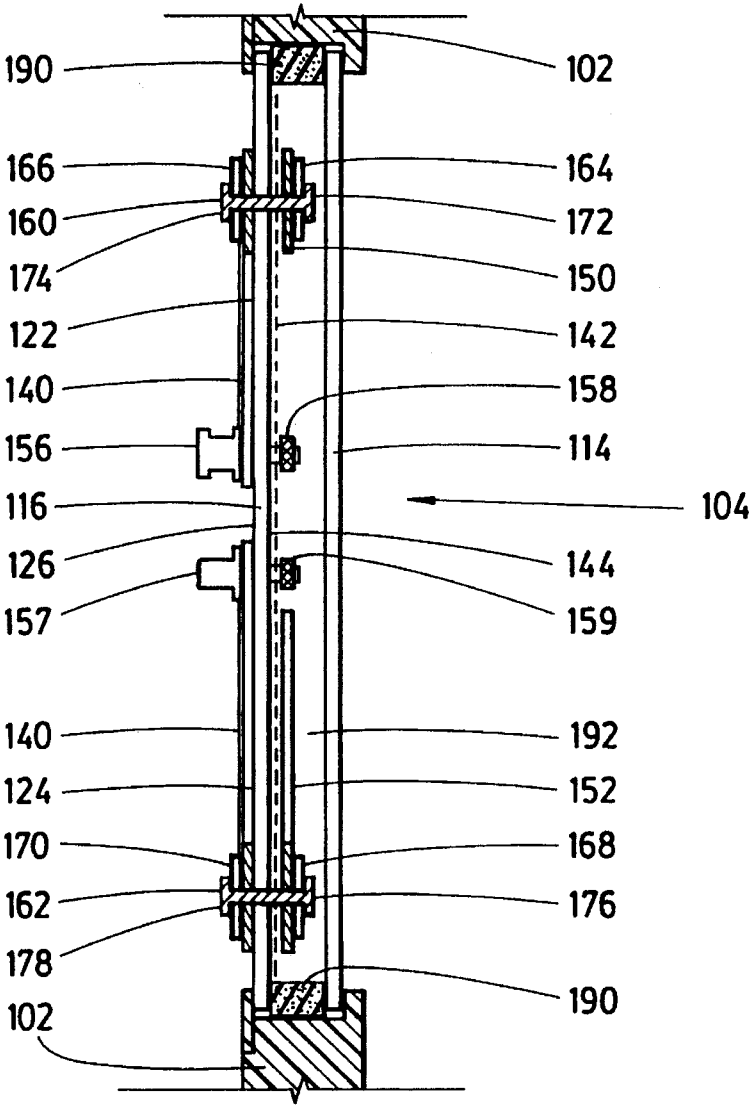
FIG. 8 is a cross-sectional view along the lines 8—8 of the face lens shown in FIG. 7.

With reference to FIG. 8, the manner of mounting lens assembly 104 in housing 102 is shown. Lens assembly 104 comprises weather lens 114, a first layer 116 and a backing layer 140. Weather lens is suitably composed of a transparent, durable material, such as polycarbonate, butyrate or acrylic.

In the embodiment shown, weather lens 114 and first layer 116 are coextensive. Weather lens 114 is spaced from first layer 116 by spacer 190. Spacer 190 is typically made from a material such as neoprene. The spacing of weather lens 114 and first layer 116 provides an air pocket 192 therebetween, which preferably is sealed.

Referring again to FIGS. 5 and 6, external terminal connector 112, shown as a co-axial connector, extends through lens assembly 104 (through first layer 116 and weather lens 114) to permit connection with an appropriate power source. As best depicted in FIG. 6, external terminal connector 112 is electrically connected to terminal connector. 118 through leads 120. Terminal connector 118, through external terminal connector 112 and leads 120, is adapted to supply an electrical current from a power source (not shown) to conductors 122 and 124.

Conductors 122 and 124 extend from terminal connector 118 toward, and then along, upper and lower margins, 130 and 132 respectively, of inner surface 126 of first layer 116, to positions in alignment with the central vertical axis 134 of first layer 116. This design with conductors 122 and 124 along margins 130 and 132 minimizes obstruction of the wearer's view in use. Conductors 122 and 124 are typically made from an electrically conductive silk screen ink. The use of electrically conductive ink for conductors 122 and 124 results in fewer components and assembly operations required in the manufacture of the face shield.

Protective tape is attached as backing layer 140 over conductors 122 and 124 to inner surface 126 of first layer 116. Backing layer 140 is useful in isolating conductors 122 and 124 from the face of the helmet wearer when in use and to protect conductors 122 and 124 from damage.

As described with reference to the embodiment of FIGS. 1 to 4, transparent electroconductive film 142 substantially covers outer surface 144 of first layer 116. A preferred embodiment of first layer 116 and electroconductive film 142 is a composite product comprising a PET substrate (polyester) to which a thin layer of indium tin oxide (ITO) is applied by sputter coating. Such an ITO coating provides high visible light transmission, low reflectivity and uniform electrical conductivity. First layer 116 is preferably made from a material such as a polycarbonate, butyrate or an acrylic.

Figure 7:
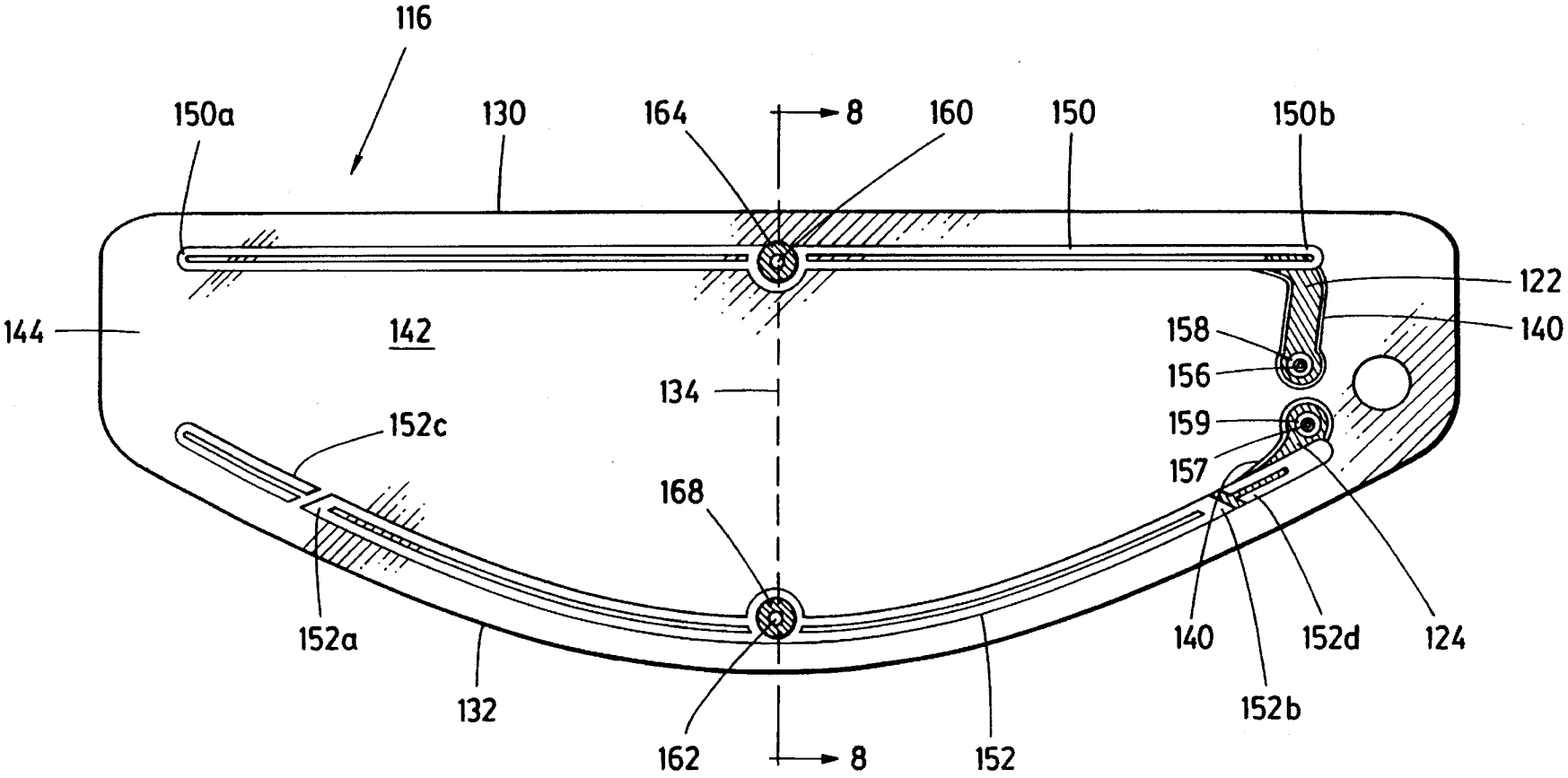
FIG. 7 is a flattened plan view of part of the face lens of the face shield shown in FIG. 5.

Shown in FIG. 7 and 8, as means for electrical connection of terminal connector 118 to conductors 122 and 124, contacts 156 and 157, both releasably connectable with terminal connector 118, are mounted upon first layer 116. Contacts 156 and 157 are electrically connected to conductors 122 and 124, respectively. Typically, terminal connector 118 comprises a common 9-volt battery connector, having both a male and female connector (not shown). Contacts 156 and 157, female and male connectors respectively, are mounted adjacent one another for connection with the ends of terminal connector 118.

As best shown in FIG. 8, where contacts 156 and 157 are attached to first layer 116 in a manner in which they may make contact with electroconductive film 142, non-conductive washers 158 and 159 are provided as insulators.

Referring again to the flattened plan view of first layer 116 of FIG. 7, first layer 116 has first and second electrodes, 150 and 152 respectively, applied over and in electrical contact with transparent electroconductive film 142 on outer surface 144. As with conductors 122 and 124, electrodes 150 and 152 are typically made from an electrically conductive silk screen ink. Again, the use of electrically conductive ink for the electrodes greatly simplifies the manufacturing process for the face shield.

Referring to both FIGS. 7 and 8, first and second electrodes 150 and 152 are electrically connected with conductors 122 and 124 with contacts 160 and 162. Preferably, contacts 160 and 162 comprise simple electricity conducting rivets attached through first and second electrodes 150 and 152 respectively, first layer 116 and conductors 122 and 124, respectively. Washer 164 is preferably sandwiched between flanged end 172 of rivet 160 and electrode 150 to improve electrical contact therebetween. Similarly, washer 166 is preferably sandwiched between flanged end 174 of rivet 160 and conductor 122. As well, washers 168 and 170 are preferably used to improve electrical contact between rivet 162 (having flanged ends 176 and 178), electrode 152 and conductor 124.

As with contacts 156 and 157, where external terminal connector 112 is attached to lens assembly through first layer 116, an insulating washer 190 is provided to prevent electrical contact between connector 112 and electroconductive film 142.

Referring to FIG. 7, as with the earlier described embodiment, an electric potential may be applied between conductors 122 and 124 through contacts 156 and 157 by applying the potential through external terminal connector 112 and leads 120 which are electrically connected to contacts 156 and 157. The electrical potential between conductors 122 and 124 will in turn establish an electrical potential between electrodes 150 and 152 which are electrically connected to conductors 122 and 124 with contacts 160 and 162. As a result of the electric potential between electrodes 150 and 152, an electrical current will flow across electroconductive film 142 between the electrodes.

As a result of the properties of the electrically conductive ink which forms electrodes 150 and 152, there will be a small decrease in electrical potential along each electrode with increasing distance laterally from contacts 160 and 162. For example, tests have shown that for a distance of approximately 15 cm, the resistance would be in the order of 1 to 2 ohms. Similarly, there will be an increase in resistance with greater distances between two points in electrical contact with electroconductive film 142. For the embodiment described herein, a resistance ranging between 10 to 15 ohms was found over electroconductive film 142 between electrodes 150 and 152. Thus, the highest potential of the pole of electrode 150, for example, will be found directly adjacent to contact 160 and the lowest potential of electrode 150 will be found at the two ends, 150*a* and 150*b*, of electrode 150 furthest from contact 160.

Referring to FIG. 7, the maximum electrical potential of the pole of electrode 150 is found at the area nearest contact 160. Likewise, the maximum electrical potential of the opposite pole of electrode 152 is found nearest contact 162. Therefore, the greatest electrical potential across electroconductive film 142 will be found between electrodes 150 and 152 nearest contacts 160 and 162. Given the decrease in electrical potential within electrodes 150 and 152 along their lateral length, the lowest electrical potential between electrodes 150 and 152 will be found between the lateral ends of each elect rode.

With the electrical potential difference between electrodes 150 and 152 across electroconductive film 142, an electrical current will flow across electroconductive film 142 between electrodes 150 and 152. The resistance to the flow of an electric current across electroconductive film 142 will cause the generation of heat in electroconductive film 142 which will tend to inhibit the formation of fog, ice or frost on the face shields surface.

As the electrical potential within the electrodes decreases with lateral distance from contacts 160 and 162, if the electrodes were separated at a constant distance across the electroconductive film 142, there would be a tendency for the electric current to pass mainly between electrodes 150 and 152 nearest contacts 160 and 162 where the greatest electrical potential between the electrodes is found. The result would be greater heating of film 142 directly between contacts 160 and 162. To compensate for this, and to provide for a more desirable heating distribution through electroconductive film 142, the ends of electrode 152 may be designed to approach electrodes 150 towards the lateral ends. With the decrease in distance between the electrodes towards the lateral ends, there is a lesser resistance to electrical flow across electroconductive film 142 and thereby an equivalent (similar level of) electrical current flow will be established although a reduced electrical potential between the electrodes drives this current flow.

Where electrodes 150 and 152 are closest, excessive electrical current may flow across film 142 causing excessive heating. As shown in FIG. 7, there is a break in the lateral extension of electrode 152 between main portion 152*a* and extension 152*c* and between main portion 152*b* and extension 152*d*. These breaks will prevent excessive electrical current flow between electrodes 150 and 152 to eliminate any excessive heating of the electroconductive film in the areas nearest the lateral ends of electrodes 150 and 152. The portions 152*c* and 152*d* of electrode 152 remain only to serve an aesthetic purpose.

It will be apparent to those skilled in the art that as a result of the pattern with which the distance between electrodes 150 and 152 is lessened with distance from axis 134, the electrical current flowing across electroconductive film 142 between electrodes 150 and 152 will not necessarily be uniform across the entire area of electroconductive film 142. However, the magnitude of the difference between electrical flow in the areas of highest flow and lowest flow in the embodiment of FIG. 7 will not be significant enough to effect the effectiveness of the face shield to inhibit the formation of fog, ice or frost on the face shield.

Figure 9:
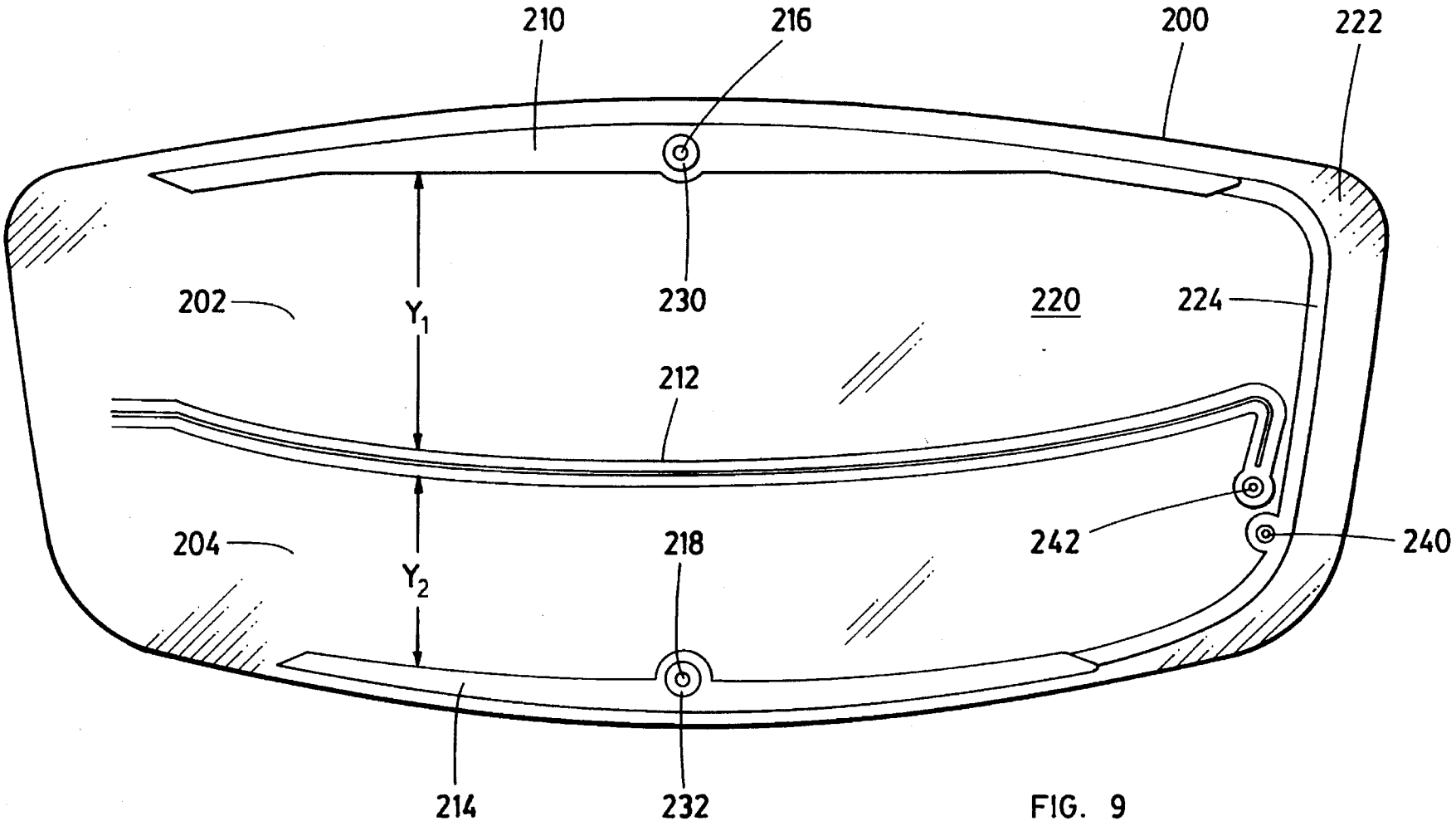
FIG. 9 is a flattened plan view of a part of a face lens of another face shield made in accordance with a further embodiment of this invention.

FIG. 9 shows a first layer 200 constructed in accordance with another aspect of the present invention. First layer 200 of FIG. 9, which of course is transparent, may be used in open face shields where first layer 200 extends over a greater area of the wearer's face than with the face shields relating to FIGS. 1 to 8 above.

The design of first layer 200 provides two separate distinct regions of heating, 202 and 204.

As shown in FIG. 9, first layer 200 includes first, second and third electrodes, 210, 212 and 214 respectively, applied over a transparent electroconductive film 220 on the outer surface 222 of first layer 200. As with the conductors and electrodes described above, electrodes 210, 212 and 214 are typically made from an electrically conductive silk screen ink. Again, the use of electrically conductive ink for the electrodes greatly simplifies the manufacturing process for the face shield.

Conductor 224, applied to the inner surface of first layer 200, is electrically connected to first and third electrodes 212 and 214 with contacts 216 and 218, respectively. As above, preferably, contacts 216 and 218 comprise simple electricity conducting rivets attached through first and third electrodes 212 and 214 respectively, first layer 200 and conductor 224. Additionally, washers 230 and 232 are used to improve electrical contact between electrodes and conductors.

As means for electrical connection of a terminal connector (not shown) to conductor 224 and second electrode 212, contacts 240 and 242, both releasably connectable to a terminal connector, are mounted upon first layer 200. Again, it is preferred that contacts 240 and 242 include female and male 9-volt battery connectors respectively. Contacts 240 and 242 are mounted adjacent one another for connection with the ends of a terminal connector.

As distance y1 between electrodes 210 and 212 is greater than distance y2 between electrodes 214 and 210, a greater resistance to the flow of current in electroconductive film will result in greater heating in region 204 between electrodes 214 and 212, while a lesser resistance to the flow of current will result in a lesser heating in region 202 between electrodes 210 and 212.

Such uneven heating is desirable in such designs of face shield as greater heating is required adjacent the mouth and nose of the wearer, while lesser heating is required adjacent the upper portion of the wearer's face.

Other variations and modifications are possible and within the scope of the invention.

We claim:

1. For a helmet face shield, a face lens comprising:

a first layer having an inner surface and an outer surface;

a first electrode extending along a first margin of said outer surface of said first layer and a second electrode extending along a second margin of said outer surface of said first layer opposite said first electrode;

a first contact electrically connected to said first electrode and extending from said outer surface through said first layer to said inner surface of said first layer to a first conductor, said first conductor extending from an end along a first margin of said inner surface of said first layer and generally along said first electrode, toward an end of said first electrode;

a second contact electrically connected to said second electrode and extending from said outer surface through said first layer to said inner surface of said first layer to a second conductor, said second conductor extending from an end along a second margin of said inner surface of said first layer opposite said first conductor and generally along said second electrode toward an end of said second electrode;

a transparent electrical conductive film extending between said first and second electrodes on said outer surface of said first layer;

means for connecting a terminal connector to said first conductor at a first connection point and to said second conductor at a second connection point, said first and second connection points located proximate one another, said terminal connector for connection to a source of electrical power; and said film having sufficient electrical resistance to create heat effective to inhibit formation of fog, ice or frost over said first layer between said electrodes when a terminal connector is connected to said first and second conductors and to a source of electricity.

2. The face lens of claim 1 wherein said first layer has a central vertical axis and said first and second contacts being located proximately in alignment with said vertical axis.

3. The face lens of claim 2 wherein said first and second electrodes are vertically spaced from each other by a distance that decreases with the distance from said vertical axis.

4. The face lens of claim 3 wherein said first electrode extends horizontally symmetric about said vertical axis and said second electrode extends in an arc symmetric about said vertical axis, said arc having its concavity oriented towards said first electrode.

5. The face lens of claim 4 wherein said electrodes are arranged such that said first electrode and said first contact oppose said second electrode and said second contact to provide approximately equal resistance to electrical conduction across said conductive film.

6. The face lens of claim 5 wherein said second electrode is shorter in length from said vertical axis than said first electrode.

7. The face lens of claim 1 further comprising a backing layer, said first and second conductors being located between said inner surface of said backing layer and said second layer.

8. The face lens of claim 7 wherein said backing layer comprises a pair of plastic strips laminated over said conductors onto said inner surface of said first layer.

9. A helmet face shield including a face lens as claimed in claim 1, said face shield further comprising, a weather lens having an inner surface and an outer surface;

a spacer means between said first layer and said weather lens for forming an appreciable air gap between said inner surface of said weather lens and said outer surface of said first layer;

a terminal connector; and an externally accessible terminal connector extending from said outer surface of said weather lens through to said inner surface of said first layer, said externally accessible terminal connector electrically connected to said terminal connector.

10. For a helmet face shield, a face lens comprising, a first layer having an inner surface and an outer surface;

a first electrode extending along a first margin of said outer surface of said first layer, a second electrode extending along a second margin of said outer surface of said first layer opposite said first electrode and a third electrode extending along said outer surface of said first layer between said first and second electrodes;

a first contact electrically connected to said first electrode and extending from said outer surface through said first layer to said inner surface of said first layer to a first conductor, said first conductor extending from an end along a first margin of said inner surface of said first layer and generally along said first electrode, toward an end of said first electrode;

a second contact electrically connected to second electrode and extending from said outer surface to said first layer to said inner surface of said first layer to a second conductor, said second conductor extending from an end along a second margin of said inner surface of said first layer opposite said first conductor and generally along said second electrode toward an end of said second electrode and electrically connected with said first conductor;

a third contact electrically connected to said third electrode and extending from said outer surface through said first layer to said inner surface of said first layer to a third conductor, said third conductor extending from an end along said inner surface of said first layer between said first and second conductors and generally along said third electrode toward an end of said third electrode;

a transparent electrical conductive film extending between said first and third electrodes and between said third and second electrodes on said outer surface of said first layer;

means for connecting a terminal connector to said first conductor in electrical contact with said second conductor at a first connection point and to said third conductor at a second connection point, said first and second connection points located proximate one another, said terminal connector for connection to a source of electrical power; and said film on said face lens having sufficient electrical resistance to create heat effective to inhibit formation of fog, ice or frost over said first layer between said first and third and said second and third electrodes when a terminal connector is connected to said first, second and third conductors and to a source of electricity.

11. The face lens claimed in claim 10, wherein said first and third electrodes are spaced on said first layer a greater distance than said third and second electrodes to provide greater heating between said third and second electrodes when said terminal connector is connected to said source of electricity.

12. A face shield for a helmet comprising:

a weather lens;

a face lens spaced from said weather lens by spacer means so as to form an appreciable air gap between said weather lens and said face lens, said face lens having a surface facing said air gap;

a first electrode extending along a margin of said face lens on said surface;

a second electrode extending along a margin of said face lens opposite said first electrode on said surface;

a terminal connector adapted for connecting to a source of electrical power;

means to electrically connect said terminal connector to a first connection point on said first electrode, proximate an end of said first electrode;

means to electrically connect said terminal connector to a second connection point on said second electrode, proximate an end of said second electrode located farthest from said end of said first electrode; and a transparent conductive film extending between said first electrode and said second electrode on said surface, said film having sufficient electrical resistance to create heat effective to inhibit formation of fog, ice, or frost upon said face shield when said terminal connector is connected to a source of electrical power.

13. The face shield of claim 12 wherein an edge of said face lens adjacent said margin along which said first electrode extends is convexly radiused and wherein an edge of said face lens adjacent said margin along which said second electrode extends is straight.

14. The face shield of claim 13 wherein the distance between any given point on said first electrode and the closest point on said second electrode to said given point is approximately the same as the distance between any further given point on said first electrode and the closest point on said second electrode to said further given point.

15. The face shield of claim 14 wherein said lenses are coextensive and said transparent conductive film substantially covers said air gap facing surface.

16. The face shield of claim 15 including seal means disposed about the periphery of said lenses to at least substantially seal said air gap.

17. The face shield of claim 16 in which the material from which the face lens is manufactured is selected from the group consisting of polycarbonates, butyrate and acrylics.

18. The face shield of claim 12 including a housing extending about the periphery of said face lens and said weather lens to support said face lens and said weather lens, and a frame having a lip, said housing joined to said frame at opposed pivots and moveable between a first closed position whereat said housing is seated on said frame and a second open position whereat said housing is pivoted away from said lip and including means for attaching said frame to a helmet.

19. The face shield of claim 18 wherein said helmet attachment means comprises a flexible band attached to said frame proximate to said pivots.

20. The face shield of claim 19 wherein said attachment means further comprises a screw associated with said frame and a track attached to said band and extending along the side of said screw such that rotation of said screw either pushes out or draws in said track in order to respectively lengthen or shorten the effective length of said band.

* * * * *